United States Patent [19]

Osborn

[11] Patent Number: 4,521,155

[45] Date of Patent: Jun. 4, 1985

[54] TURBOCHARGER COMPRESSOR HOUSING

[76] Inventor: Norbert L. Osborn, 402 W. Grauwyler, Irving, Tex. 75061

[21] Appl. No.: 157,196

[22] Filed: Jun. 6, 1980

Related U.S. Application Data

[63] Continuation of Ser. No. 917,065, Jun. 19, 1978, abandoned.

[51] Int. Cl.[3] ..... F04D 29/42

[52] U.S. Cl. ..... 415/190; 415/217; 415/219 A; 415/219 C; 417/406

[58] Field of Search ..... 415/219 R, 219 A, 219 C, 415/189, 190; 417/405, 406, 407; 285/332; 29/156.4 R, DIG. 10

[56] References Cited

U.S. PATENT DOCUMENTS

| | | | |
|---|---|---|---|
| 925,065 | 6/1909 | Wilstam | 415/190 |
| 2,026,839 | 1/1936 | Krause | 29/DIG. 10 |
| 2,126,200 | 8/1938 | Linderman | 29/DIG. 10 |
| 2,709,567 | 5/1955 | Wood | 417/407 X |
| 2,997,229 | 8/1961 | Quan | 415/217 |
| 3,068,638 | 12/1962 | Birmann | 415/219 A |
| 3,071,313 | 1/1963 | Weisel | 415/219 A |
| 3,173,241 | 3/1965 | Birmann | 415/219 A |
| 3,258,283 | 6/1966 | Winberg et al. | 285/332 X |

*Primary Examiner*—Michael Koczo

*Attorney, Agent, or Firm*—Richards, Harris, Medlock & Andrews

[57] ABSTRACT

A turbocharger compressor housing unit includes an outer housing and a wall insert for engagement with the outer housing. The outer housing has a compressor inlet port, a wall transverse to the inlet port and extending outwardly therefrom and a circumferential chamber attached to the transverse wall spaced from the inlet port. The chamber has an opening substantially in the plane of the transverse wall. The wall insert is formed with a tubular throat having a disc attached at one end of the tubular throat transverse thereto. The disc has an aperture corresponding to an opening defined through the throat. Rivet protrusions are integrally formed and extend from the disc and correspond to apertures in the transverse wall of the compressor housing. The rivet protrusions engage the apertures in the transverse wall to join the insert to the outer housing with the disc in engagement with the transverse wall. The disc partially encloses the opening in the plane of the wall of the circumferential chamber. The inlet port has an inside surface with a first portion having a varying diameter converging toward the wall and a second portion diverging in diameter toward the transverse wall. The tubular throat of the wall insert has an inside surface converging in diameter toward the disc and an outside surface with a diameter diverging toward the disc to mate with the diverging inner surface of the inlet port. A bearing support cylinder is positioned within the inlet port by a plurality of vanes attached to and extending inwardly from the inner wall of the inlet port. The vanes have a leading edge and a trailing edge separated by a thicker intermediate vane section. The tubular throat of the wall insert is notched to correspond with the vanes such that the throat wall straddles the vanes when the wall insert is attached to the outer housing.

9 Claims, 8 Drawing Figures

TURBOCHARGER COMPRESSOR HOUSING

This is a continuation of application Ser. No. 917,065, filed June 19, 1978, now abandoned.

BACKGROUND OF THE INVENTION

1. Field of the Invention

The present invention relates to turbochargers and more particularly to a turbocharger compressor rotor housing.

2. Prior Art

Power output of a naturally aspirated internal combustion engine may be significantly increased by the addition of a turbocharger. Turbochargers include a compressor, generally of the positive-displacement or dynamic type, for providing an air or air fuel charge at a greater than ambient pressure and density to the combustion chamber. The turbocharger normally includes a turbine, driven by exhaust gases from the turbocharged engine for powering the compressor.

Centrifugal flow compressors are one of the most widely used dynamic compressors in turbochargers. In this compressor type, air or an air-fuel mixture enters the compressor inlet, is channeled to the compressor rotor and is accelerated to near sonic speeds at a right angle to the inlet flow path. Increase in air pressure is accomplished by reducing the velocity of the accelerated gases as discharged from the tip of the compressor rotor blades. This process, known as diffusion, is more efficiently achieved by slowing down the gases without turbulence so that a large percentage of the velocity energy is converted into pressure energy, raising the static pressure.

To facilitate this diffusion process, turbochargers employing centrifugal compressors have normally included a compressor rotor wall closely following the contour of the compressor rotor blades from the blade leading edge to its outer tip. This compressor wall extends past the outer tip of the blade, then terminates to provide a circumferential gap through which the compressed gases are channeled into a chamber leading to the intake manifold of the engine. This wall, facing the compressor rotor blades and closely contoured to the rotor blades, uniformly decreases the velocity of the gases after the gases leave the rotor blades and prior to their entry into the chamber leading to the engine. Thus, this wall structure greatly increases the static pressure generated by the compressor.

To form this structure, most turbocharger compressor housings have been sand cast with the compressor wall cast in one piece with the compressor outer surround housing. This has normally been accomplished by using a sand core to form the circumferential chamber leading to the intake manifold of the engine. After casting, this sand core is dislodged to produce the chamber on the opposite side of the wall from the compressor in which gases are channeled off of the tips of the compressor rotor.

Although die-casting of the compressor housing would be substantially less expensive and more accurate than sand castings, die-casting of an optimum design has not been possible because of the inability to use die-cast molds to form the circumferential chamber which channels the compressed gases to the intake manifold of the engine and at the same time form the diffuser wall. Because the variable area chamber is necessarily larger than the inlet gap through which gases are injected from the compressor rotor blades, die-casting an optimum design compressor housing has not been possible because of the inability to design molds that would form this passageway behind the wall facing the blades of the compressor rotor.

Where die-cast compressor housings are used, the wall normally formed in sand cast compressor housings is merely deleted so that the molds may be brought together and parted to form the casting. However, without this wall, gases accelerated by the compressor rotor are prematurely dumped from the compressor rotor blades into the circumferential chamber leading into the engine intake manifold. As a result, this arrangement realizes a substantially lower compressor efficiency and thus lower performance.

SUMMARY OF THE INVENTION

The present invention provides a turbocharger compressor rotor housing unit and a method for casting such a unit which overcomes many of the deficiencies hereinbefore experienced in the prior art. The housing unit includes a compressor housing and a compressor wall insert for mating with the compressor housing. The compressor housing includes a tubular shaped inlet port having a transverse wall attached to one end of the tubular port and extending outwardly therefrom. A circumferential chamber is attached to the wall opposite the inlet port and has a circumferential opening substantially in the plane of the wall. The circumferential chamber also has an opening which communicates with the intake manifold of the engine to which the turbocharger is attached.

The wall insert is formed having a tubular throat with a circular disc attached at one end of the tubular throat transverse thereto. The disc has an aperture corresponding to the opening formed by the tubular throat. Rivet-like protrusions are integrally formed and extend from the disc corresponding to and facing apertures formed in the wall of the compressor housing. These protrusions are circumferentially spaced around the tubular throat and correspond in position to the apertures formed around the inlet port in the transverse wall of the compressor housing. The protrusions engage the apertures to join the insert to the compressor housing such that the circular disc forms a forward diffuser wall of the turbocharger.

The tubular throat of the insert fits within the inlet port allowing the circular disc to abut the transverse wall of the compressor housing for engagement thereto. The disc extends beyond the transverse wall and partially encloses the opening in the plane of the wall of the circumferential chamber.

In accordance with one embodiment of the invention, the inlet port is formed with an inside surface having a first portion remote from the transverse wall with a varying diameter converging toward the wall and a second portion adjacent the compressor housing transverse wall diverging in diameter toward the wall. The tubular throat of the wall insert has an inside surface converging in diameter toward the circular disc and an outside surface diverging in diameter toward the disc to mate with the diverging inner surface of the inlet port of the compressor housing. The inner surface of the throat portion of the wall insert converges at substantially the same rate as the inlet port inner surface to form a continuous converging surface from the opening into the inlet port to the area adjacent the insert disc where the compressor rotor is positioned.

As is now appreciated, the compressor housing unit consists of two components which are cast separately and joined to form the completed unit. By so doing, the components are designed so that they may be die-cast while still providing a forward diffuser wall for closing the circumferential chamber except for an annular gap through which compressed air is channeled from the blade tips of the compressor rotor.

In accordance with another embodiment of the invention, the housing unit further includes a bearing support cylinder positioned from the inner wall of the inlet port by a plurality of vanes extending from the inner wall. The vanes are aligned to be substantially radial from the center line of the inlet port with a leading edge facing the opening to the inlet port and a trailing edge substantially opposite the leading edge. The leading and trailing edges are separated by thicker intermediate vane sections.

In accordance with still another embodiment of the invention, one end of the tubular throat of the compressor wall insert is notched to correspond with the vanes such that the throat straddles the vanes when the tubular throat is inserted within the inlet port.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENTS

Figure 1:
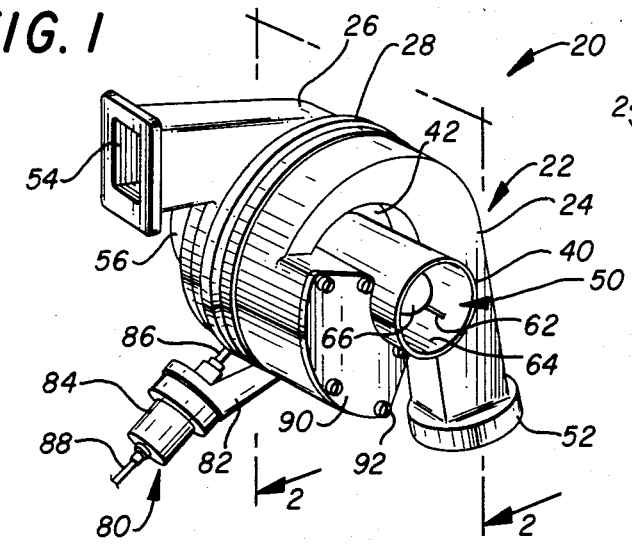
FIG. 1 is a perspective view of a turbocharger embodying the present invention.

FIG. 1 is a perspective view of a turbocharger 20 embodying the present invention. The turbocharger includes an outer structure 22 consisting of a compressor housing unit 24 coupled to a turbine housing unit 26 by a V-clamp band 28.

Figure 2:
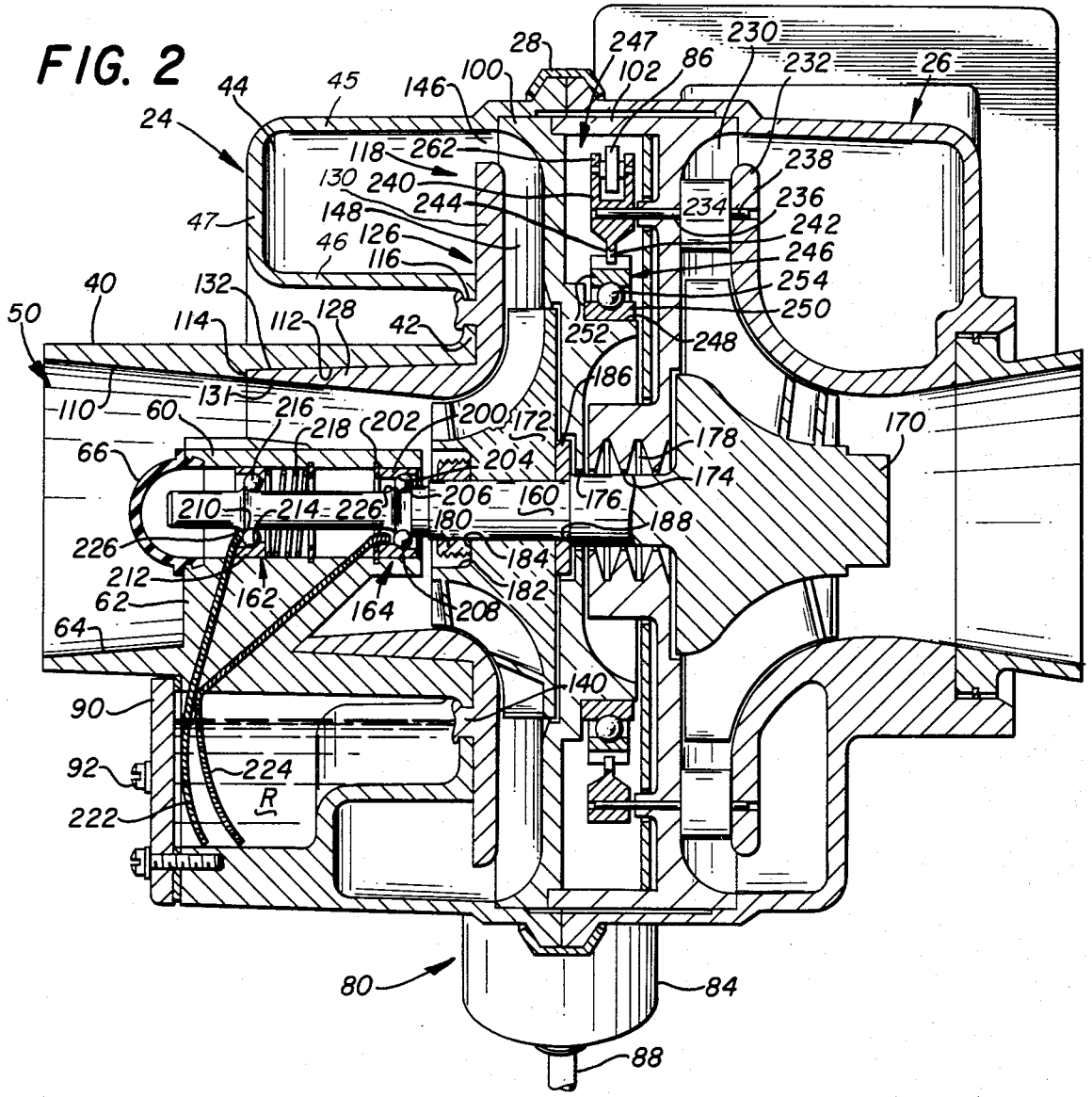
FIG. 2 is a vertical section taken along lines 2—2 of the turbocharger illustrated in FIG. 1.

Referring to FIGS. 1 and 2, compressor housing unit 24 includes a tubular inlet port 40 with a transverse wall 42 attached to one end of port 40 and extending outwardly therefrom. A circumferential chamber 44 is attached from wall 42. Circumferential chamber 44 includes an inner wall 45 and outer wall 46 joined by a back wall 47. Inner and outer walls 45 and 46 are oriented such that they diverge slightly one from the other from the back wall. Inlet port 40 defines a compressor air inlet 50 and circumferential chamber 44 defines a compressor exhaust 52. Turbine housing 26 defines a turbine air inlet 54 and a turbine exhaust 56.

In operation of the turbocharger, air is drawn into inlet 50 and compressed air is discharged from exhaust 52 to an internal combustion engine to which the turbocharger is mounted. Exhaust gas from the engine is channeled into turbine gas inlet 54 to drive the turbocharger turbine and is exhausted through turbine exhaust 56.

Referring still to FIGS. 1 and 2, a bearing support cylinder 60 is mounted within inlet port 40 by a plurality of vanes 62 extending from the inside wall surface 64 of inlet port 40. A cap 66 is mounted over the end of support cylinder 60. A piston type actuator 80 is mounted by bracket 82 (FIG. 1) to turbine housing 26. Actuator 80 includes a pressure controlled cylinder 84 operated to extend and retract control rod 86 as will be discussed hereinafter in greater detail. An air line 88 provides air to cylinder 84 as necessary to operate rod 86. An oil reservoir cover plate 90 is attached to compressor housing unit 24 by a plurality of screws 92.

Referring specifically to FIG. 2, a compressor diffuser backwall 100 and a turbine backwall 102 are positioned intermediate of compressor housing unit 24 and turbine housing unit 26 when these two units are assembled. These four components are piloted one to another and held in assembly by V-clamp 28. Compressor housing unit 24 includes a tubular inlet port 40 with a transverse wall 42 attached to one end thereof to one of the inlet ports and extending outwardly therefrom. A circumferential chamber 44 is attached to the end of wall 42 remote from inlet port 40 and has a varying area around its circumference increasing to the discharge provided by compressor exhaust 52 (FIG. 1).

Inlet port 40 has a first inside wall portion 110 having a converging diameter toward wall 42 and a second inside wall portion 112 joined to first inside wall portion 110 by a step 114. The second inside wall portion 112 has a diverging diameter toward wall 42. Wall 42 has a plurality of circumferentially spaced apertures 116 therethrough. Chamber 44 has an opening 118 substantially in the plane of wall 42 in addition to compressor exhaust 52.

A forward compressor wall insert 126 includes a tubular throat 128 and a circular disc 130 attached transversely from one end of throat 128. Throat 128 has an inside wall surface 131 having a diameter converging toward disc 130 and an outer surface 132 having a diameter diverging toward disc 130. The diverging diameter surface 132 corresponds to the diverging surface of inside wall portion 112 of inlet port 40 such that throat 128 may be inserted within and mated with inlet port 40. The converging diameter inside wall surface 131 of throat 128 corresponds to the extension of converging diameter of first inside wall portion 110 of inlet port 40. When insert 126 is mated into inlet port 40, a continuous converging diameter is provided from the inlet of port 40 inwardly into the turbocharger.

A plurality of rivet-like protrusions 140 extend from disc 130 and correspond to apertures 116 in wall 42. With the insert engaged to compressor housing 24 with the end of throat 128 engaging step 114 of inlet port 40, protrusions 140 are engaged through apertures 116 with disc 130 abutting the corresponding surface of wall 42. As is shown in FIG. 2, protrusions 140 have been inserted into apertures 116 and the heads thereof deformed to attach insert 126 to housing 24. Disc 130 extends beyond wall 42 to partially cover opening 118 of chamber 44 to form a forward compressor diffuser wall. A circumferential gap 146 is formed between the outer tip of disc 130 and the wall of chamber 44. Additionally, a circumferential passageway 148 is formed between disc 130 and compressor backwall 100 between rotor 172 and gap 146 leading to chamber 44.

Referring still to FIG. 2, bearing support cylinder 60 is supported concentrically within inlet port 40 by a plurality of vanes 62 extending inwardly from wall surface 64 of port 40. Turbocharger 20 further includes a shaft 160 supported for rotation in bearing support cylinder 60 by two ball bearing assemblies 162 and 164. A radial flow turbine rotor 170 is mounted at one end of shaft 160 and a centrifugal flow compressor rotor 172 is mounted intermediate of turbine rotor 170 and bearing assemblies 162 and 164. Shaft 160 passes through apertures 174 and 176 in turbine backwall 102 and compressor backwall 100, respectively. A labyrinth seal 178 is provided on turbine backwall 102 to seal between compressor rotor 172 and turbine rotor 170.

Turbine rotor 170 is fixedly attached to shaft 160, such as by welding, and compressor rotor 172 is retained in position on shaft 160 by retainer nut 180. Compressor rotor 172 is drilled to receive shaft 160 and counterbored to form a bore 182. Bore 182 has a diameter larger than the outer diameter of retainer nut 180 such that retainer nut 180 may be pressed onto shaft 160 into engagement with the bottom wall 184 of bore 182 to retain the compressor rotor in position on shaft 160. A compressor blade shim 186 is positioned between compressor rotor 172 and a step 188 in shaft 160.

A ring 200 is fitted within the end of cylinder 60 adjacent compressor rotor 172 and is prevented from moving into cylinder 60 by a clip 202 attached to cylinder 60. Outer raceway 204 of bearing assembly 164 is formed in ring 200, the inner raceway 206 being integrally formed in shaft 160. Balls 208 are engaged between the inner and outer raceways to form bearing assembly 164.

Bearing assembly 162 includes inner raceway 210 formed integrally in shaft 160 and an outer ring 212 slidable within cylinder 60 with an outer raceway 214 formed therein for receiving balls 216. A compression spring 218 is engaged between ring 212 and a retaining ring 220 fixed within cylinder 60 and biases ring 212 outwardly to fix the position of balls 216 and 208 in bearing assemblies 162 and 164, respectively, thereby fixing the position of shaft 160.

As is shown in FIG. 2, outer raceway 204 is formed in ring 200 with the ball radius on only one side. Thus, the assembly of bearing assembly 164 is made by positioning a full compliment of balls 208 in raceway 206, and engaging ring 200 therearound. Similarly, outer raceway 214 is formed in ring 212 with the ball radius on only one side. Balls 216 of bearing assembly 162 are assembled by outer ring 212 to compression spring 218 and inserting a full compliment of balls 216 in raceway 214 of shaft 160. By releasing ring 212, spring 218 automatically forces the ring into engagement with balls 216 to form bearing assembly 162 while simultaneously engaging ring 200 against balls 208 of bearing assembly 164.

Alternatively, less than a full compliment of balls 208 and 216 may be used in bearing assemblies 162 and 164 by the use of an appropriate retainer. Depending upon the application, an oil impregnated retainer or a sacrificial retainer which replenishes a self-lubricating coating to the balls may be used. The mounting of shaft 160 within cylinder 60 is completed by the engagement of cap 66 on the end of cylinder 60 to close the opening in cylinder 60 remote from compressor rotor 172.

In a preferred embodiment of the invention, bearing assemblies 162 and 164 are "starved" of oil. The only lubrication provided to the bearing assemblies is through wicks 222 and 224 which transfer oil from a reservoir R by capillary action to ramps or slingers 226. Oil supplied to slingers 226 is projected by centrifugal force to bearing assemblies 162 and 164 during rotation of shaft 160.

Referring to FIGS. 1 and 2, exhaust gas from the internal combustion engine on which the turbocharger is mounted is injected into the turbocharger through turbine gas inlet 54 and channeled against the blades of turbine rotor 170 through a nozzle area 230 formed by turbine backwall 102 and a wall 232 parallel thereto. This nozzle area is controlled by a plurality of movable nozzle vanes 234 positioned circumferentially about the nozzle area and rotatable to vary flow of exhaust gas to turbine rotor 170. Vanes 234 include trunnions 236 and 238 extending from opposite sides thereof. Trunnion 236 extends through turbine backwall 102 and is attached to actuation lever 240. Trunnion 238 extends into wall 232.

A nipple 242 is formed on one end of each actuation lever. These nipples extend into radial holes 244 formed in a control ring 246. Control ring 246 and actuation levers 240 are situated in air space gap 247 intermediate of compressor rotor 172 and turbine rotor 170. Control ring 246 is concentrically positioned about the axis of shaft 160 and is received on a cylindrical surface 248 extending from compressor backwall 100.

In a preferred embodiment of the invention, control ring 246 includes an inner ring 250 and an outer ring 252 formed with an inner and outer raceway, respectively, for receiving a plurality of balls 254 therebetween. Inner ring 250 is fixedly attached to the cylindrical surface 248 extending from compressor backwall 100, and outer ring 252 rotates angularly relative to the inner ring. By the rotation of outer ring 252, each of the actuation levers 240 is rotated about the axis of trunnions 236 and 238 resulting in the simultaneous rotation of each nozzle vane 234. One of the actuation levers 240 is provided with an extension 262. Control rod 86 is attached to the end of extension 262 remote from nipple 242. By the movement of control rod 86, actuation lever 240 is pivoted to angularly rotate outer ring 252 of control ring 246 thereby rotating each of the other actuation levers 240 and nozzle vanes 234 attached thereto.

As discussed above, control rod 86 is controlled by piston type actuator 80. Actuator 80 is controlled by compressor discharged pressure fed into cylinder 84 through line 88. Increased pressure into actuator 80 causes the extention of control rod 86 and the corresponding opening of the compressor nozzle area. While the preferred embodiment of the invention envisions the use of a piston type actuator using compressor discharged pressure as the control parameter, it will be understood by those skilled in the art that various other types of control actuators may be used without deviating from the scope of the present invention.

A more detailed description of the construction and operation of nozzle vanes 234 is set forth in a copending application Ser. No. 759,773, filed Jan. 14, 1977, now U.S. Pat. No. 4,179,247, which is incorporated herein by reference for all purposes.

Figure 3:
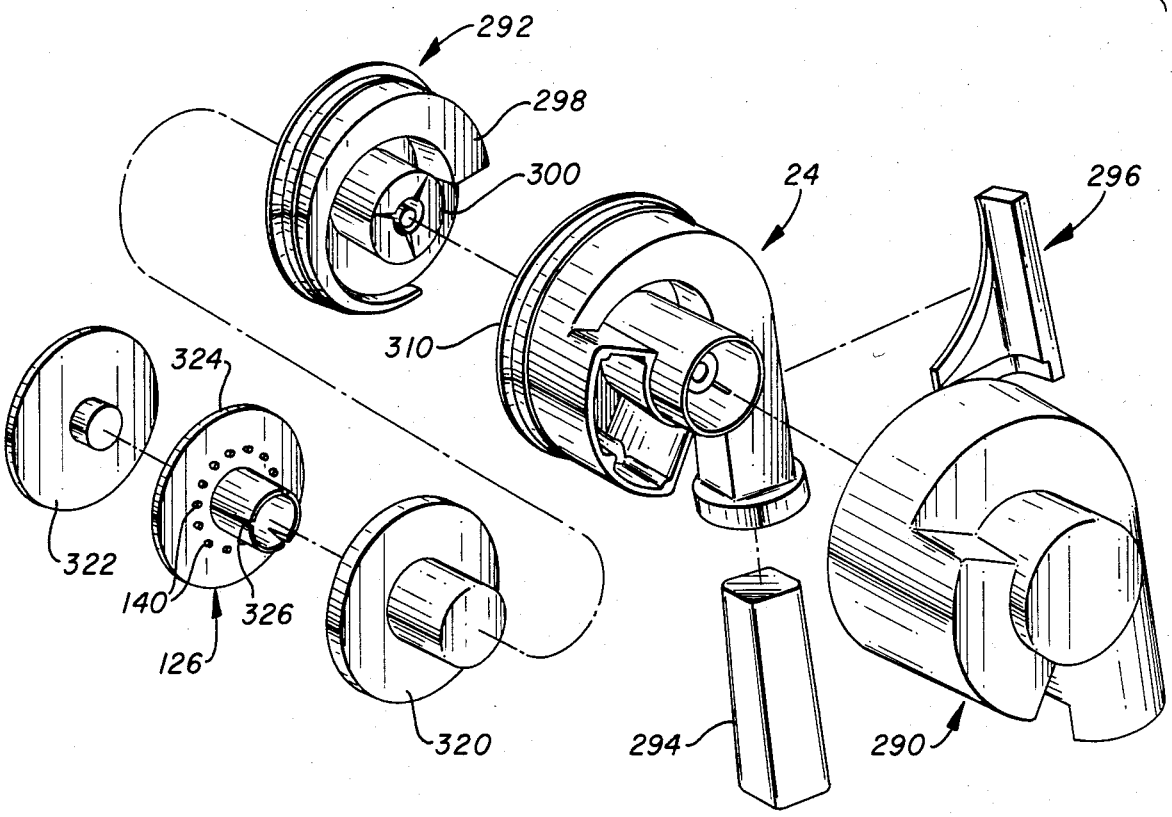
FIG. 3 is an exploded perspective view showing the two components of the compressor housing unit separated from molds used to make the components.

FIG. 3 illustrates compressor housing 24 and forward compressor wall insert 126 and their respective molds used in die-casting these two pieces. Heretofore, the compressor housing portion of many turbochargers have been sand cast so that the circumferential chamber in which compressed air is directed for channeling to the intake manifold of the engine with which the turbocharger is used, could be formed with a substantially enclosed configuration having a narrow circumferential gap for receiving compressed air therein. Forming the compressor housing unit in one piece by sand casting is substantially more expensive and produces a less accurate structure than a comparable die-cast unit with much rougher wall surfaces in the circumferential chamber. However, where the turbocharger compressor housing has been die-cast in the past, it has not been possible to produce the forward diffuser wall as is possible in a sand casting because of the necessity of providing proper ingress and egress for the die-cast molds.

The present invention provides a two component die-cast compressor housing unit which upon assembly provides the advantages heretofore only afforded by a sand cast unit. As is shown in FIG. 3, compressor housing 24 is formed by using an outer mold 290, an inner mold 292, a core mold 294 and a cap mold 296. Referring still to FIG. 3, mold 292 is formed with raised contour 298 to form circumferential chamber 44. Mold 292 also has a protrusion 300 for mating with a corresponding protrusion from mold 290 for forming inlet port 40, vanes 62 and bearing support cylinder 60. Core mold 294 and cap mold 296 are used to form compressor exhaust 52.

As can be seen in FIG. 3, molds 290, 292, 294 and 296 cooperate to make possible the die-casting of compressor housing unit 24. Molds 290 and 292 are constructed with abutting surfaces to form parting line 310 on housing 24. Mold 290 abuts mold 296 during the molding process to form parting line 312 on compressor housing 24.

Molds 320 and 322 cooperate to produce forward compressor wall insert 126. Molds 320 and 322 have abutting surfaces which engage one another to produce insert 126 with a parting line 324 on the outer edge of disc 130. As can best be seen in FIG. 4, throat 128 is formed with notches 326 which receive vanes 62 when insert 126 is mounted into housing 24.

Figure 4:
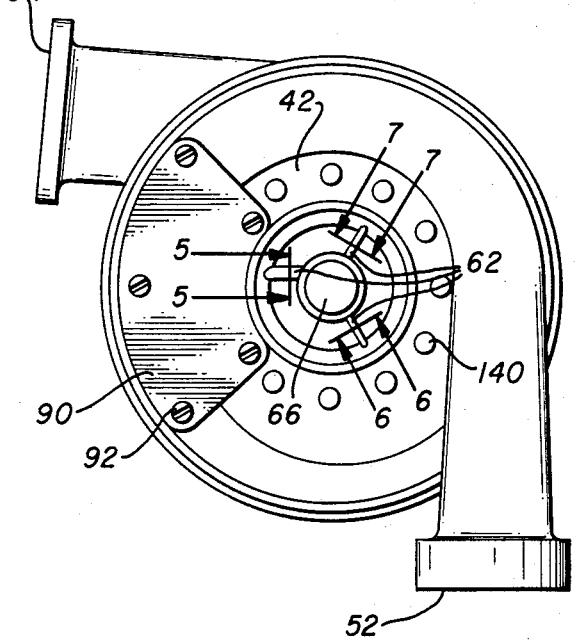
FIG. 4 is a frontal view looking into the inlet port of the turbocharger illustrated in FIG. 1.
Figure 5:
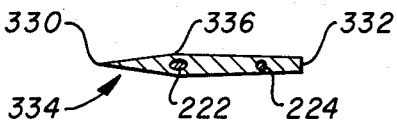
FIG. 5 is a section view taken along lines 5—5 of FIG. 4.
Figure 6:
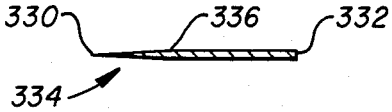
FIG. 6 is a section view taken along lines 6—6 of FIG. 4.
Figure 7:
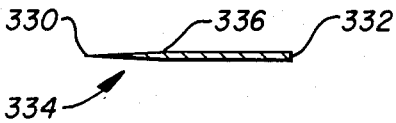
FIG. 7 is a section view taken along lines 7—7 of FIG. 4.

FIG. 4, and section views 5, 6 and 7 illustrate the positioning and configuration of vanes 62. Referring to FIGS. 5, 6 and 7, each of the vanes 62 has a leading edge 330 and a trailing edge 332 with a thicker intermediate midsection 334. In each case, the thickest midsection is that indicated by a line 336 defining the parting line between molds 290 and 292 used in the formation of housing 24. Thus, vanes 62 may be formed by die-casting using molds 290 and 292 to produce the desired airfoil configuration of a leading and trailing edge separated by a thicker midsection therebetween. This configuration, shown in FIGS. 5, 6 and 7, greatly facilitates the ingress of air into the compressor inlet area, and in the configuration of the present invention, may be cast using well known die-casting techniques.

To accomplish this airfoil configuration of vanes 62 such that the vanes tapper from a thicker midsection to thinner leading and trailing edges, the die-cast molds must be inserted into inlet port 40 from both the forward and rearward ends. Thus, referring to FIGS. 2 and 3, the second inside wall portion 112 is formed by protrusion 300 of mold 292 while first inside wall portion 110 is formed by mold 290. Both the first and second inside wall portions 110 and 112, respectively, diverge outwardly to permit removal of the die-cast mold after formation of the piece.

Thus, the formation of the desired geometry of vanes 62 requires a diverging diameter surface 112 in inlet port 40 to permit removal of the die-cast molds. However, it is critical to have a continuously converging diameter from the inlet of inlet port 40 to the compressor rotor. This is accomplished by use of wall insert 126. Wall insert 126 is formed, also by die-casting, with a diverging outer diameter surface 132 corresponding to the diverging surface of inside wall portion 112 of inlet port 40 for mating therewith. Inside wall surface 131 of throat 128 is formed with a diameter converging toward disc 130 corresponding to the extension of converging diameter of first wall portion 110 of inlet port 40. Thus, when insert 126 is mated with inlet port 40, a continuous converging diameter is provided from the inlet of port 40 inwardly to compressor rotor 172. Thus, the present invention provides a two piece structure for forming the compressor housing for a turbocharger, both of which may be die-cast. Upon assembly, these two components produce a compressor housing having a plurality of vanes 62 supporting a bearing support structure 60 with the vanes having a thicker intermediate section converging to a thinner leading and to a thinner trailing edge. The housing further provides a continuously converging inlet nozzle from the inlet of the inlet port to the compressor rotor. Further, the compressor housing provides a forward diffuser wall for completing the circumferential chamber in which compressed gases are channeled to the compressor exhaust.

Figure 8:
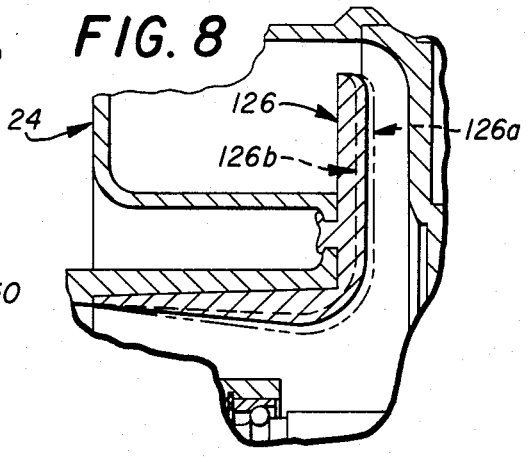
FIG. 8. illustrates an alternative embodiment of the present invention wherein the forward diffuser wall is modified to modify the turbocharger characteristics.

FIG. 8 shows an adaptation of the invention illustrated in FIGS. 1–7 wherein differing geometries of insert walls 126 may be substituted one for the other for use with corresponding compressor rotors. Referring to FIG. 8, wall insert **126*a* provides a more restrictive air flow into the turbocharger while wall insert 126*b* provides for a larger compressor rotor and greater air flow into the turbocharger. It will now be appreciated that modification of the design of the present invention may be accomplished by merely fitting differing wall inserts 126 to a standard compressor housing unit 24. Thus, several different turbochargers, having different power capabilities, may be produced from the present invention using a standard compressor housing unit 24 by selecting one of any number of possible geometries for wall insert 126**.

In prior art turbocharger units, either of the die-cast or sand cast variety, any modifications would involve producing a totally new casting for each new design. In the present invention, a different turbocharger design is achieved by simply substituting a wall insert of one design for one of a differing design.

Therefore, the present invention provides a turbocharger compressor housing unit which may be die-cast. The compressor rotor housing unit includes a compressor housing and forward wall insert for engagement with the housing. This two component construction permits each of the two components to be die-cast using standard die-casting techniques. In their combined configuration, a compressor rotor housing is produced having a circumferential chamber closed on all sides except for a circumferential gap for receiving compressed gases from the compressor rotor. A circumferential passageway is also provided leading to this gap to the chamber wherein accelerated gases are diffused to increase static pressure.

Moreover, a compressor bearing support cylinder is cast concentric with the inlet port and supported therein by a plurality of vanes extending from the inner wall of the inlet port. The vanes are formed with a leading and trailing edge separated by a thicker midsection. This is accomplished through the use of molds having a parting line substantially at the thicker cross sectional area to permit die-casting of the compressor housing.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. While the present invention of die-casting a compressor housing unit in two components has been applied to a turbocharger wherein the compressor rotor and turbine rotor are overhung to one side of and supported from a shaft rotatable on ball bearing assemblies, it will be apparent to one skilled in the art that the present invention may readily be adapted to turbochargers of the conventional design having the compressor rotor and turbine rotor supported on opposite sides of shaft bearing support assemblies. In this particular application, the heretofore described compressor housing unit would be directly usable with only modification of the bearing support cylinder. Thus, the present invention is intended to encompass this and other rearrangements, modifications and substitutions of parts and elements as fall within the scope of the appended claims.

What is claimed is:

1. In a turbocharger having a compressor housing with an inlet port, a circumferential chamber surrounding said inlet port and leading to a compressor exhaust port, and a compressor rotor mounted for rotation in the housing for compressing air entering the inlet port and discharging the compressed air into the chamber for exhaust through the exhaust port, said compressor housing comprising:

an outer housing defining the inlet port and the circumferential chamber around the inlet port, a wall insert including a tubular throat with a disc attached at one end of the tubular throat transverse thereto, said disc having an aperture corresponding to an opening in the throat and said throat engageable within the inlet port when said insert is mounted to said housing, means for attaching said insert within said outer housing with said insert forming one wall of the circumferential chamber and forming a circumferential passageway between the compressor rotor and the circumferential chamber for channeling compressed air from the rotor to the chamber, wherein said attachment means comprises rivet protrusions integrally formed and extending from the disc and corresponding to and facing apertures in the wall of the outer housing circumferentially spaced around the inlet port, said rivet protrusions adapted for insertion into said apertures to join said insert to said outer housing, said inlet port having an inside surface with a first portion remote from said wall insert having a varying diameter converging toward the compressor rotor, a second portion adjacent the compressor rotor diverging in diameter toward the compressor rotor, and wherein the tubular throat of said insert has an inside surface converging in diameter toward the disc and an outside surface diverging in diameter toward the disc to mate with the diverging inside surface of the inlet port of said outer housing.

2. In a turbocharger having a compressor housing with an inlet port, a circumferential chamber surrounding said inlet port and leading to a compressor exhaust port, and a compressor rotor mounted for rotation in the housing for compressing air entering the inlet port and discharging the compressed air into the circumferential chamber for exhaust through the exhaust port, said compressor housing comprising:

an outer housing defining the inlet port and the circumferential chamber around the inlet port connected thereto by a transverse wall, a wall insert including a tubular throat with a disc attached at one end of the tubular throat transverse thereto, said disc having an aperture corresponding to an opening in the throat and said throat engageable within the inlet port when said insert is mounted to said housing, means for attaching said insert within said outer housing with said insert forming one wall of the circumferential chamber and forming a circumferential passageway between the compressor rotor and the circumferential chamber for channeling compressed air from the rotor to the chamber, said inlet port having an inside surface with a first portion remote from said wall insert having a diameter converging toward the compressor rotor, a second portion adjacent the compressor rotor diverging in diameter toward the compressor rotor, wherein the tubular throat of said insert has an inside surface converging in diameter toward the disc and an outside surface diverging in diameter toward the disc to mate with the diverging inside surface of the inlet port of said outer housing, and said circumferential chamber having a radially inner wall and a radially outer wall joined by a back wall to form the circumferential chamber, said inner and outer walls being oriented such that said walls slightly diverge one from the other from said back wall, said inner wall of said circumferential chamber being oriented such that the radially outer surface of said inner wall does not converge toward the radially outer surface of said inlet port from said transverse wall.

3. The compressor housing according to claim 2 wherein the inside surface of the throat portion of said insert converges along a straight line at substantially the same rate as the inlet port inside surface converges to form a continuous converging surface from the end of the inlet port remote from the insert disc to the disc aperture.

4. In a turbocharger having a compressor housing with an inlet port, a circumferential chamber surrounding said inlet port and leading to a compressor exhaust port, and a compressor rotor mounted for rotation in the housing for compressing air entering the inlet port and discharging the compressed air into the chamber for exhaust through the exhaust port, said compressor housing comprising:

an outer housing defining the inlet port and the circumferential chamber around the inlet port, a wall insert, means for attaching said insert within said outer housing with said insert forming one wall of the circumferential chamber and forming a circumferential passagway between the compressor rotor and the circumferential chamber for channeling compressed air from the rotor to the chamber, a bearing support cylinder, and a plurality of vanes attached to and extending inwardly from the inside wall of the cylindrical housing inlet port, said vanes having a leading edge opposite said compressor rotor and a trailing edge facing said rotor, said leading and trailing edges being separated by a thicker intermediate vane section, said surfaces of said vanes converging from the thickest intermediate vane section to the leading and trailing edges, one end of said tubular throat being notched to correspond with said vanes such that said throat straddles said vanes when said insert is attached to said outer housing.

5. A turbocharger compressor rotor housing unit comprising:

a compressor housing having a compressor inlet port, a wall transverse to the inlet port and extending outwardly therefrom, and a circumferential chamber attached to the wall opposite the inlet port, the chamber having an opening substantially in the plane of the wall, a wall insert having a tubular throat with a disc attached at one end of the tubular throat transverse thereto, said disc having an pperture corresponding to an opening in the throat, attachment means for joining said insert to said compressor housing with said disc in engagement with the wall of said compressor housing such that said disc partially encloses the opening in the plane of the wall of the circumferential chamber, wherein said attachment means comprises rivet protrusions integrally formed and extending from the disc and corresponding to and facing apertures in the wall of the compressor housing circmferentially spaced around the inlet port, said rivet protrusions spaced around the inlet port, said rivet protrusions adapted for insertion into said apertures to join said insert to said compressor housing, said inlet port having an inside surface with a first portion remote from said wall insert having a varying diameter converging toward the wall of said compressor housing, a second portion adjacent the compressor housing wall diverging in diameter toward the wall of said compressor housing, and wherein the tubular throat of said wall insert has an inside surface converging in diameter toward the disc and an outside surface diverging in diameter toward the disc to mate with the diverging inside surface of the inlet port of said compressor housing.

6. A turbocharger compressor rotor housing unit comprising:

a compressor housing having a compressor inlet port, a wall transverse to the inlet port and extending outwardly therefrom, and a circumferential chamber attached to the wall opposite the inlet port, the chamber having an opening substantially in the plane of the wall, a wall insert having a tubular throat with a disc attached at one end of the tubular throat transverse thereto, said disc having an aperture corresponding to an opening in the throat, attachment means for joining said insert to said compressor housing with said disc in engagement with the wall of said compressor housing such that said disc partially encloses the opening in the plane of the wall of the circumferential chamber, said inlet port having an inside surface with a first portion remote from said wall having a diameter converging toward the wall of said compressor housing, a second portion adjacent the compressor housing wall diverging in diameter toward the wall of said compressor housing thereby facilitating die casting of said housing, wherein the tubular throat of said wall insert has an inside surface converging in diameter toward the disc and an outside surface diverging in diameter toward the disc to mate with the diverging inside surface of the inlet port of said compressor housing and facilitating die casting said insert, and said circumferential chamber having radially innner wall and a radially outer wall joined by a back wall to form the circumferential chamber, said inner and outer walls being oriented such that said walls slightly diverge one from the other from said back wall, said inner wall of said circumferential chamber being oriented such that the radially outer surfaces of said inlet wall does not converge toward the radially outer surface of said inlet port from said transverse wall.

7. The housing unit according to claim 6 wherein the inside surface of the throat portion of said wall insert converges at substantially the same rate as the inlet port inside surface converges to form a continuous converging surface from the end of the inlet port remote from the insert disc to the disc aperture.

8. The housing unit according to claim 6 further comprising:

a bearing support cylinder, and a plurality of vanes attached to and extending inwardly from the inside wall of the cylindrical housing inlet port, said vanes having a leading edge opposite said compressor wall and a trailing edge facing said wall, said leading and trailing edges being separated by a thicker intermediate vane section.

9. The housing unit according to claim 8 wherein one end of said tubular throat is notched to correspond with said vanes such that said throat straddles said vanes when said wall insert is attached to said compressor housing.

* * * * *